US009466167B2

(12) United States Patent
Razzaboni et al.

(10) Patent No.: US 9,466,167 B2
(45) Date of Patent: Oct. 11, 2016

(54) DEVICE FOR FILLING AND CLOSING DISPOSABLE BAGS FOR CONTAINING BANKNOTES

(71) Applicant: Cima S.p.A., Mirandola (MO) (IT)

(72) Inventors: Nicoletta Razzaboni, Mirandola (IT); Vittorio Razzaboni, Mirandola (IT)

(73) Assignee: CIMA S.P.A., Mirandola (MO) (IT)

( * ) Notice: Subject to any disclaimer, the term of this patent is extended or adjusted under 35 U.S.C. 154(b) by 0 days.

(21) Appl. No.: 14/889,060

(22) PCT Filed: May 8, 2014

(86) PCT No.: PCT/IB2014/061298

§ 371 (c)(1),
(2) Date: Nov. 4, 2015

(87) PCT Pub. No.: WO2014/181286

PCT Pub. Date: Nov. 13, 2014

(65) Prior Publication Data

US 2016/0086416 A1 Mar. 24, 2016

(30) Foreign Application Priority Data

May 9, 2013 (IT) ..... MI2013A0751

(51) Int. Cl.
*G07D 11/00* (2006.01)
*B65B 5/06* (2006.01)
(Continued)

(52) U.S. Cl.
CPC ..... *G07D 11/0096* (2013.01); *B65B 5/067* (2013.01); *B65B 5/106* (2013.01);
(Continued)

(58) Field of Classification Search
CPC ..... B65B 5/067; B65B 5/106; B65B 25/14; B65B 35/40; B65B 35/50; B65B 39/06; B65B 39/08; B65B 43/54; B65B 63/02; B65B 63/026; B65H 29/46; B65H 31/10; B65H 31/14; B65H 2405/311; G07D 11/0009; G07D 11/0096
USPC ..... 53/116, 117, 120, 528, 530, 540, 567, 53/570, 576, 577, 258, 284.7; 232/43.2, 232/43.3; 271/180
See application file for complete search history.

(56) References Cited

U.S. PATENT DOCUMENTS 3,173,742 A * 3/1965 Simjian ..... G07D 11/0096 232/43.3
3,655,186 A * 4/1972 Bayha ..... B65H 29/46 271/180

(Continued)

FOREIGN PATENT DOCUMENTS

DE 4141830 A1 * 6/1993 ..... B65B 5/067
DE 10 2009 053 155 A1 5/2011

(Continued)

*Primary Examiner* — Stephen F Gerrity
(74) *Attorney, Agent, or Firm* — Jacobson Holman, PLLC.

(57) ABSTRACT

A device for filling and closing disposable bags for containing banknotes includes a container for the temporary housing of one or more banknotes. The container has side walls and a bottom with an opening for the exit of the one or more banknotes from the container. A piston for pushing the one or more banknotes towards the bottom of the container. A bag made of flexible material intended to be filled with the banknotes temporarily housed in the container is wrapped around the side walls and the bottom of the container. A plate, placed below the container, is vertically movable through controlled lowering of a device, such as a spring. Sealing elements for heat sealing the filled bag are placed between the container and the plate.

10 Claims, 3 Drawing Sheets

Figure 2:
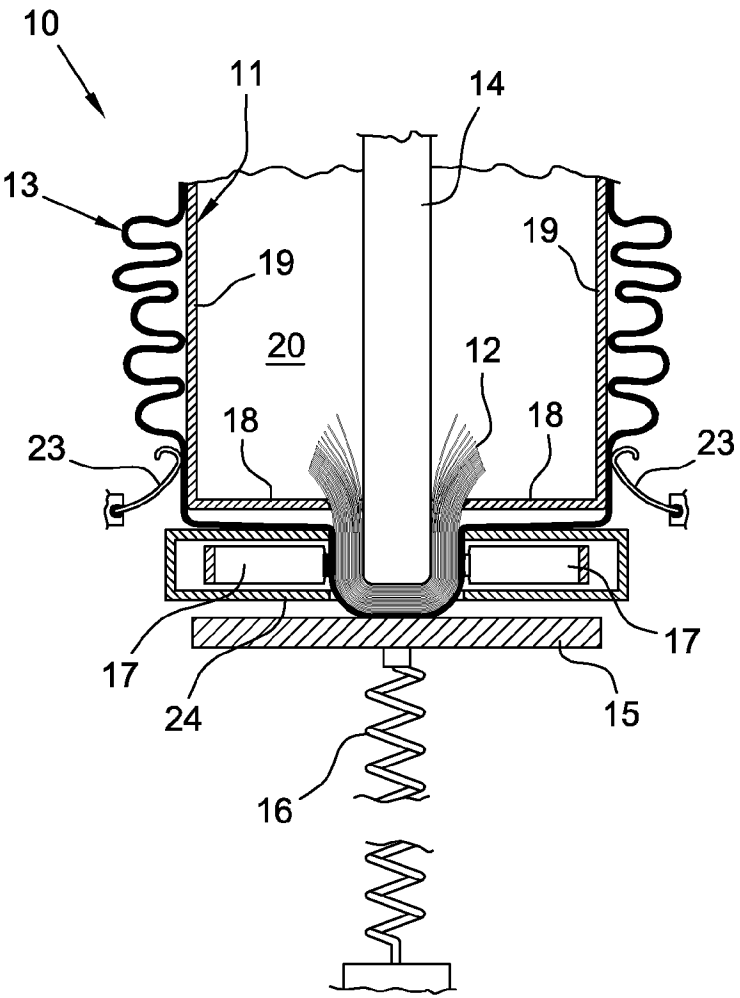

(51) Int. Cl.

| | |
|---|---|
| ***B65B 5/10*** | (2006.01) |
| ***B65B 25/14*** | (2006.01) |
| ***B65H 29/46*** | (2006.01) |
| ***B65H 31/04*** | (2006.01) |
| ***B65H 31/10*** | (2006.01) |
| ***B65B 35/50*** | (2006.01) |
| ***B65B 39/08*** | (2006.01) |
| ***B65B 43/54*** | (2006.01) |

(52) U.S. Cl.
CPC ..... *B65B 25/14* (2013.01); *B65B 35/50* (2013.01); *B65B 39/08* (2013.01); *B65B 43/54* (2013.01); *B65H 29/46* (2013.01); *B65H 31/04* (2013.01); *B65H 31/10* (2013.01); *G07D 11/0009* (2013.01); *B65H 2405/311* (2013.01)

(56) References Cited

U.S. PATENT DOCUMENTS 3,805,482 A * 4/1974 O'Shea et al. ..... B65B 25/145 53/120
3,919,827 A * 11/1975 Larson et al. ..... B65B 25/145 493/451
4,027,460 A * 6/1977 Orr ..... B65B 9/13 53/535
4,472,923 A * 9/1984 Herrington ..... B65B 25/145 53/120
5,148,655 A * 9/1992 Salinas ..... B65B 5/067 53/245
5,595,129 A * 1/1997 Grobe ..... G07D 11/0012 109/22
5,899,452 A * 5/1999 Walsh ..... B65H 29/46 271/180
2003/0180131 A1* 9/2003 Lewis ..... G07D 11/0009 414/411
2007/0145064 A1* 6/2007 Clauser et al. .... G07D 11/0009 221/197
2011/0052363 A1 3/2011 Brexel et al.
2012/0167529 A1 7/2012 Langhuber et al.
2015/0000230 A1* 1/2015 Wright ..... B65B 5/067 53/459

FOREIGN PATENT DOCUMENTS

EP 2648165 A1 * 10/2013 ..... G07D 11/0009
JP 02295852 A * 12/1990
WO 02/19289 3/2002

* cited by examiner

DEVICE FOR FILLING AND CLOSING DISPOSABLE BAGS FOR CONTAINING BANKNOTES

BACKGROUND OF THE INVENTION

The present invention refers to a device for filling and closing disposable bags for containing paper documents, in particular banknotes.

Such device is intended to be used in machines for storing banknotes, usually present in banks, supermarkets, shopping malls or the like.

In the prior art, the banknotes are introduced into these machines through an inlet port and then they are inserted into boxes or into plastic bags removably housed in the machine.

In case or use of plastic bags, these can advantageously be of the disposable type, i.e. bags which, after filling, are sealed by appropriate sealing blades at the edges of the their mouth so that, once opened, they cannot be used again.

Obviously, the use of plastic bags instead of rigid boxes implies various difficulties both as regards fixing the bag to the machine and introducing the banknotes into the bag up to its correct filling, these difficulties essentially being due to lack of rigidity of the bag and in particular to the flexibility of its walls. On the other hand, the disposable plastic bags are simple and inexpensive to be made, they are light and easy to be handled and they do not require any maintenance.

US-A-2011/0052363 discloses a system in which a banknote is introduced one at a time, through a roller feeding device, into the bag, which is placed horizontally and fixed to a support frame provided with a seat within which the bag is initially rolled. Each banknote is introduced into the bag oriented vertically and, as the banknotes are progressively introduced into the bag, the pack that is thus formed is translated horizontally along a conveyor belt which supports it, thus causing an extension of the bag which unrolls from its seat. The pack of banknotes is laterally accompanied by a support plate at the bottom of the bag, while a pressing element on the opposed side of the pack with respect to the aforementioned, support contributes to keep the banknotes constantly compact in the bag.

The solution described in this prior art document however implies a considerable structural complexity and, thus, even high implementation costs.

Document WO-A-02/19289 provides for a piston for facilitating the entry of the banknotes into the box or into a bag.

BRIEF SUMMARY OF THE INVENTION

The general object of the present invention is to overcome the aforementioned drawbacks by providing a device for filling and closing disposable bags for containing paper documents, in particular banknotes, capable of allowing an orderly depositing of the banknotes into the bag and that is simple and inexpensive to be obtained and easy to be used, without requiring complex and cumbersome mechanisms for moving the banknotes and the bag.

With the aim of attaining such object according to the invention it was conceived to provide a device for filling and closing disposable bags for containing banknotes, comprising:

- a container for the temporary housing of one or more banknotes, having side walls and a bottom with an opening for the exit of said one or more banknotes from the container,

- a pushing piston for pushing said one or more banknotes towards the bottom of the container,
- a bag made of flexible material intended to be filled with the banknotes temporarily housed in the container, which is wrapped around the side walls and the bottom of the container,
- a plate for supporting the bag containing the banknotes which is vertically movable through means for the controlled lowering of said plate and placed below the container, and
- sealing elements placed between the container and the plate.

BRIEF DESCRIPTION OF THE SEVERAL VIEWS OF THE DRAWING(S)

With the aim of providing a better description of the innovative principles and advantages of the present invention in the following there is a description of a possible embodiment applying such principles, with reference to the attached drawings, wherein;

FIGS. 1-6 schematically illustrate, partially sectioned, a device according to the invention, represented in subsequent operating steps, starting from the beginning of the loading of the banknotes up to the sealing of the bag.

DETAILED DESCRIPTION OF THE INVENTION

The device is intended to be contained in known machines (not shown in the drawings attached herein) for storing banknotes, usually present in banks, supermarkets, shopping malls or the like. For the sake of description simplicity, herein reference shall be made to banknotes, but the device according to the invention may be equally used for treating and handling other paper documents in form of sheets.

In the figures it is schematically illustrated, partially sectioned, a device 10 consisting essentially of a container 11 within which the banknotes 12, intended to be introduced into a bag 13, are temporarily housed, of a pushing piston 14 for pushing the banknotes towards the bottom of the container 11, of a plate 15 for supporting the bag containing the banknotes, placed below the container 11 and which is vertically movable through controlled lowering means 16, and of sealing elements 17, placed between the container 11 and the plate 15 and intended to seal the inlet of the bag once filling is completed.

Advantageously, according to a particularly simple and inexpensive embodiment, the means 16 for the controlled lowering of the plate 15 consists of a compression spring.

The container 11 comprises a fixed bottom 18 and side walls 10, so as to define an inner space 20 adapted to receive the banknotes before they are introduced into the bag.

The banknotes, coming from a storage compartment inside the machine or directly from the entry port from outside, may be introduced into the space 20 singularly or by groups of several banknotes, using feeding means well known to the person skilled in the art and thus not shown in the drawings.

The bottom 18 of the container 11 is provided with an opening 21 aligned with the piston 14. The opening 21 has a passage section smaller than the surface of the banknotes, so that the banknotes not pushed by the piston 14 are held in the space 20 by resting the peripheral portions thereof at the sides of the opening 21.

According to the invention, the bag 13 (advantageously made of flexible plastic film) is wrapped externally to the container 11 around its side walls 19 and its bottom 18 and it initially (FIG. 1) covers below and closes the opening 21 of the bottom 18 of the container.

Advantageously, the plastic film forming the bag is wrapped loose around the side walls 19 of the container 11 with a plurality of bends 22 which constitute a reserve for the lengthening and distension of the bag during the subsequent steps of filling with the banknotes, as will be described in detail hereinafter. The device 10 also comprises pressing elements 23 (for example elastic leafs) for keeping the bag 13 fitted on the container 11 in proximity of the lower end of the latter, thus below the bends 22, to allow a correct slipping off of the bag itself due to the action of the weight of the banknotes contained therein and due to the force exerted by the piston 14 moving the banknotes downwards.

Figure 1:
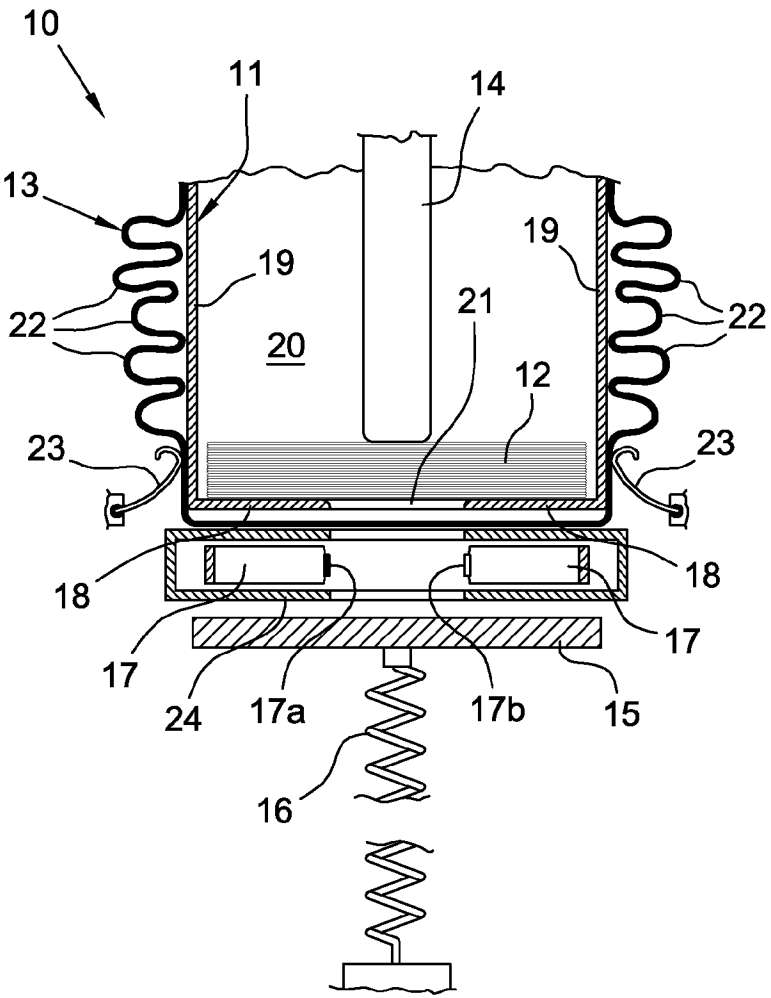

FIG. 1 illustrates the device according to the invention in a first operating step, in which a bundle of banknotes 12 is temporarily received at the bottom, of the space 20 of the container 11, resting on the fixed bottom 18 of the container.

Though the operations of introducing the banknotes into the bag are herein described with reference to several banknotes stacked in bundles in the container 11, the same operating principles may also apply in cases where a single banknote is handled at a time so as to be introduced into the bag 13.

In the condition of FIG. 1 the plate 15 is unloaded and it is held in position of maximum lift by the force of the spring 16. The piston 14 is instead advantageously pushed downwards to hold the banknotes pressed against the bottom of the container 11.

FIG. 2 illustrates a subsequent operating step of the device according to the invention, in which the piston 14 exerts on the banknotes 12 a greater downward pressure, such to push the banknotes to be introduced with a central portion thereof into the opening 21 of the bottom 18 of the container 11 up to coming into contact with the plate 15, with the plastic film of the bottom portion of the bag interposed between the banknotes and the plate. In this step, the banknotes are deformed as illustrated in the figure so as to exit from the container 11 through the opening 21.

As observable from the figures, the piston 14 has a transversal dimension smaller than the passage section of the opening 21, so as to be able to be inserted thereinto accompanying the banknotes towards the plate 15.

Figure 3:
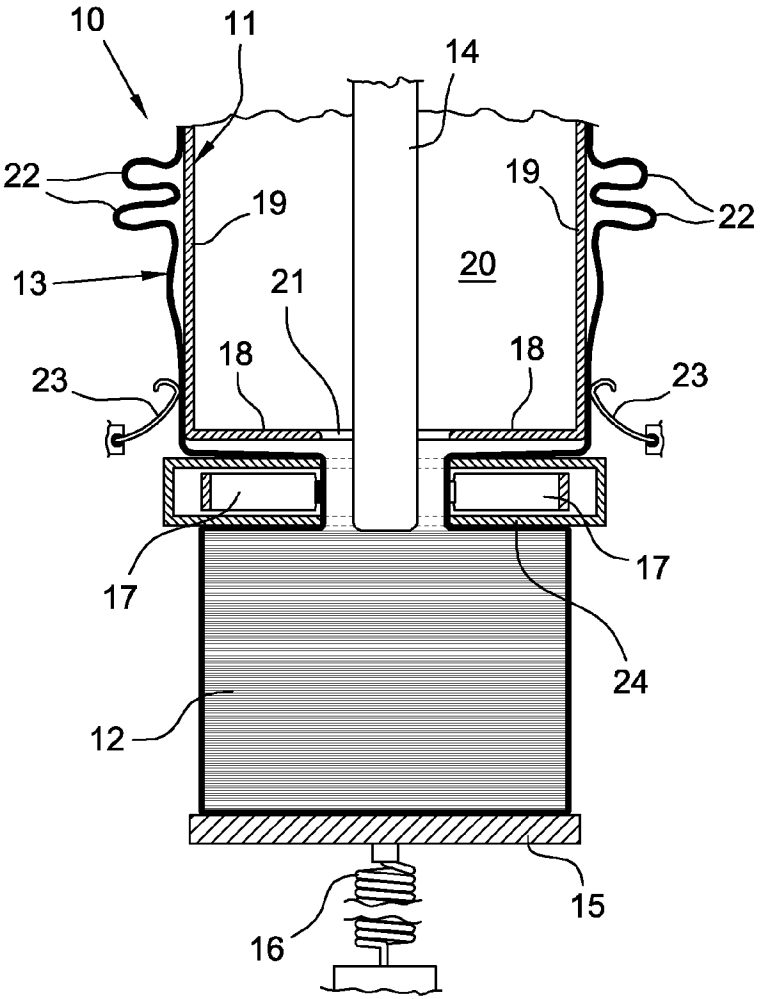

FIG. 3 illustrates a subsequent operating step, in which a plurality of bundles (or single banknotes) is passed from the container 11 to the bag 13 through a sequence of operations like those described regarding FIG. 2. As the banknotes enter into the bag 13 their weight, alongside the thrust against them exerted by the piston 14, lowers the plate 15 against the action of the spring 16 and simultaneously unrolls the bag 13 (in particular, its bends 22) from the side walls 19 of the container 11 against, the elastic holding force exerted by the pressing elements 23.

In particular, FIG. 3 shows the device in the moment when the piston 14 accompanies the last banknote (or bundle of banknotes) into the bag 13.

The lowering of the plate 15 can advantageously occur along appropriate guides, as can be imagined by a person skilled in the art and thus not shown in the figures.

Figure 4:
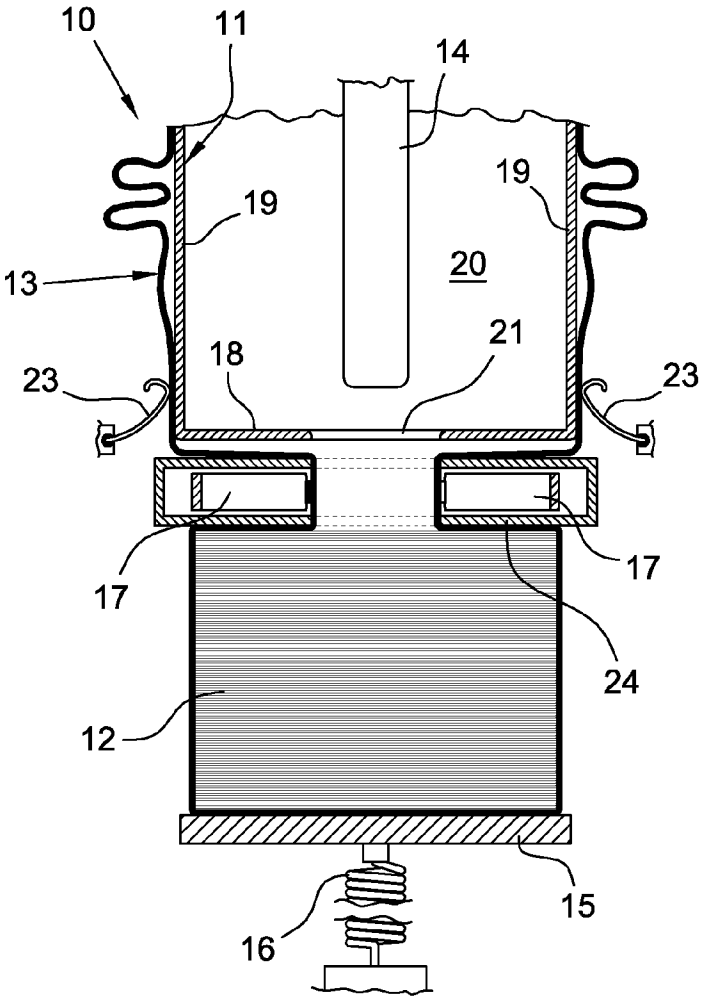

FIG. 4 illustrates an operating step of the device in the rest condition, immediately subsequent to the introduction of the last banknote into the bag 13, where the piston 14 is receded upwards without exerting pressure on the banknotes in the bag any more. In this condition, the upward pressure of the plate 15 pushed by the spring 16 keeps the banknotes in the bag 13 compacted against the sealing elements 17 (still with the interposition of the plastic film which constitutes the bag) or against appropriate sheets 24 for protecting the sealing elements, if provided for as shown by way of example in the present FIGS. 1-6).

From a static point of view, the rest condition illustrated in FIG. 4 is the same that occurs in intermediate loading steps, awaiting the new banknotes to reach the container 11 so as to be introduced into the bag.

Figure 5:
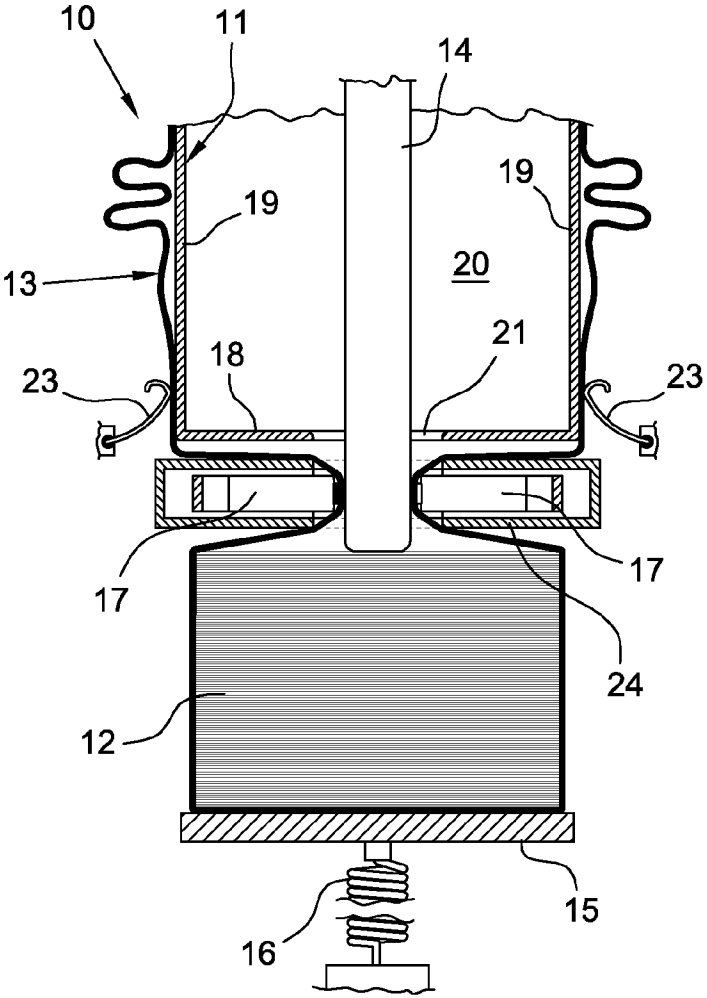

FIG. 5 illustrates the device 10 at the beginning of the operation of closing the bag. The piston 14 is lowered so as to move the banknotes away from the sealing elements 17 (or from their protection sheets 24, if provided for), with a corresponding lowering of the plate 15 against the action of the spring 16. Simultaneously, the sealing elements 17 are brought close to the piston 14.

Figure 6:
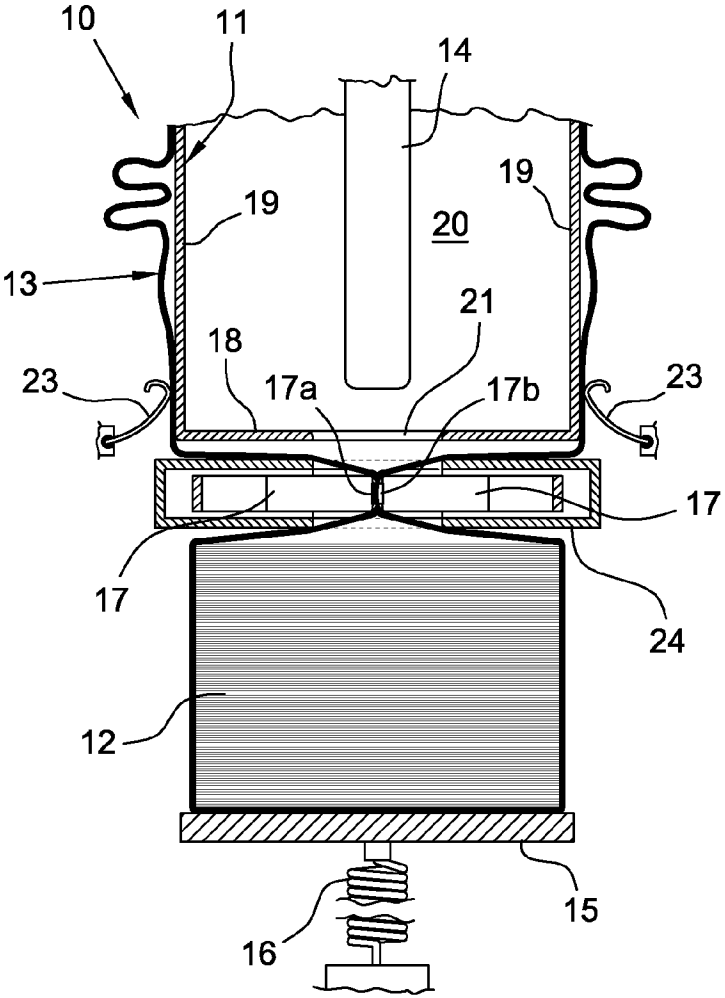

FIG. 6 illustrates the final step of sealing the bag. While the piston 14 is lifted to move away from the sealing area, the sealing elements 17, horizontally moveable, are drawn up close together and brought to mutual contact, with the plastic film which forms the bag interposed therebetween.

The heat sealing may be advantageously obtained by passing electrical, current in the sealing bar 17*a* present on one of the two sealing elements while it is pressed against the counter-bar 17*b* present on the other sealing element.

Then, the sealing elements 17 are moved away and the bag containing the banknotes can be picked up.

At this point it is clear that, according to the invention, it has been possible to obtain a device for filling a bag with banknotes and its sealing, the device not being cumbersome, being easy and inexpensive to be obtained as well as easy to be used.

Obviously, the above description outlining an embodiment applying the innovative principles of the present invention is provided by way of exemplifying such innovative principles and thus shall not be deemed to be a restriction of the scope of protection claimed herein.

For example, the elastic means 16 for opposing the lowering of the plate 15 could also be obtained by a traction spring or by a gas spring.

Lastly, instead of wrapping a single bag 13 on the container 11 one at a time, there could be provided for a continuous supply of a tube of plastic film wrapped around the container 11 (advantageously coming from above with reference to the figures). In this case, the bottom of the bag positioned below the opening 21 in the bottom of the container 11 would be obtained due to the sealing of the mouth of the previously filled bag. This solution would allow to minimise the waste particles, in particular in cases where a bag is filled only partly and thus there is a considerable extension of the film downstream of the sealing that is applied.

The invention claimed is:

1. A device for filling and closing disposable bags for containing banknotes, comprising:

a container for the temporary housing of one or more banknotes, having side walls and a bottom with an opening for the exit of said one or more banknotes from the container, said bottom and side walls defining an inner space of the container for reception of the banknotes before their introduction into the bag, a pushing piston for pushing said one or more banknotes towards the bottom of the container, a bag made of flexible material intended to be filled with the banknotes temporarily housed in the container, which is wrapped externally to the container around the side walls and bottom of the container, a plate for supporting the bag containing the banknotes which is vertically movable through means for the controlled lowering of said plate and placed below the container, and sealing elements placed between the container and the plate.

2. The device according to claim 1, wherein said means for the controlled lowering consists of a spring and the plate is vertically movable against the pushing action of said spring.

3. The device according to claim 1, wherein the bottom of the bag is placed between the bottom of the container and the plate.

4. The device according to claim 1, wherein the bag is wrapped around the side walls of the container with a plurality of bends suitable for creating a reserve for the lengthening and distension of the bag while it becomes filled with banknotes.

5. The device according to claim 4, wherein the device comprises pressing elements acting against the bag and the side walls of the container below the bends of the bag.

6. The device according to claim 5, wherein the pressing elements are placed close to the lower end of the container.

7. The device according to claim 1, wherein the opening for the exit of said one or more banknotes from the container is aligned with the piston.

8. The device according to claim 7, wherein the opening has a passage section smaller than the surface of the banknotes.

9. The device according to claim 8, wherein the piston has a transversal, dimension smaller than the passage section of the opening.

10. The device according to claim 1, wherein the sealing elements are horizontally movable towards each other to carry out a heat sealing of the mouth of the bag.

* * * * *